United States Patent [19]

Moelders

[11] 4,018,006

[45] Apr. 19, 1977

[54] SPINNING JET BLASTING PLANT FOR CLEANING SHAPED WORKPIECES

[75] Inventor: Johann Moelders, Cologne, Germany

[73] Assignee: Berger Maschinenfabriken G.m.b.H. & Co., Bergish-Gladbach, Germany

[22] Filed: Nov. 17, 1975

[21] Appl. No.: 632,786

[30] Foreign Application Priority Data

Nov. 20, 1974 Germany ..... 2454866

[52] U.S. Cl. ..... 51/9 R

[51] Int. Cl.[2] ..... B24C 3/00

[58] Field of Search ..... 51/9, 15 R

[56] References Cited

UNITED STATES PATENTS

| | | | |
|---|---|---|---|
| 2,154,878 | 4/1939 | Turnbull | 51/9 |
| 2,154,879 | 4/1939 | Turnbull | 51/9 |
| 2,887,826 | 5/1959 | Schultz | 51/9 |
| 3,517,465 | 6/1970 | Freeman et al. | 51/9 X |
| 3,748,787 | 7/1973 | Carpenter et al. | 51/15 R |

*Primary Examiner*—Al Lawrence Smith
*Assistant Examiner*—James G. Smith
*Attorney, Agent, or Firm*—Hamilton, Renner & Kenner

[57] ABSTRACT

Apparatus for surface cleaning of workpieces by blasting comprising an elongated rotatable cage having longitudinally spaced rings through which the workpieces are conveyed axially, while they are being blasted, by means of oscillating arms extending between the cage rings and engaging the workpieces.

10 Claims, 5 Drawing Figures

SPINNING JET BLASTING PLANT FOR CLEANING SHAPED WORKPIECES

BACKGROUND OF THE INVENTION

The invention relates to a spinning jet blasting plant for cleaning shaped workpieces, in which the workpieces are guided in continuous sequence into a rotating cage and are moved through the cage parallel to its axis of rotation where the blasting medium impinges upon them. In known plants (German PS Nos. 1,652,262 and 1,652,263 as well as German OS No. 2,202,975), the rotary cage must either be stationary for charging the workpieces or the workpieces must be preaccelerated in a receiving cage or head arranged ahead of the rotary cage to a cage speed corresponding to the speed of rotation. Subsequently the workpieces are pushed in with a central push rod. Because this push rod must also undertake the pushing forward of the workpieces already in the cage, an intermittent non-uniform conveying movement through the cage results during impingement of the blasting medium, and therefore a corresponding non-uniform effectiveness of the blasting. As long as the push rod (German OS No. 2,202,975) is not equipped with special entrainment cams associated with the individual workpieces, the workpieces are pushed through the cage with their end faces lying against one another so that these end faces can not be, or can only be incompletely, blasted.

SUMMARY OF THE INVENTION

The invention has the object of avoiding the disadvantages particularly associated with conveying the workpieces through the cage. The solution consists in that the rotary cage comprises a plurality of rings spaced apart from one another with ring planes lying transverse to the rotation axis of the cage, and vertical arms of an oscillating comb arranged underneath the rotary cage project between the rings and have carrying and conveying elements for moving the workpieces through the cage. The oscillating comb can be connected with an oscillating channel arranged in a known manner underneath the rotary cage, for carrying away the used blasting medium and sand. The through passage cross-section of the rings is purposely formed so that the workpieces inside the rings can carry out no independent turning movement opposite to the direction of rotation of the cage, and so that the through passage cross-section moves itself into the zone of the arms of the inclined comb once or more during a cage rotation.

The rings forming the rotary cage can also be arranged eccentrically to the axis of rotation so that one or more rings are allowed to form a multichamber cage in a single plane.

On the delivery or entrance end of the rotary cage, in place of the rings, forked elements conforming in part to the through passage cross-section of the rings form an extension of the cage. The forked elements have prongs extending out from the passage cross-section of the rings to gather the workpieces guided thereto, and guide them into the cage extension formed by the forked elements. In a corresponding manner, U-shaped elements, likewise in part conforming to the passage cross-section of the rings, can be arranged at the discharge end of the cage and permit the radial expulsion of the blasted workpieces onto an onward conveyor.

Besides the achievement of a continuous conveying movement of the workpieces in the direction of the cage axis during rotation in the blasting zone, the invention brings a further advantage in that the workpieces are vibrated during the loading on the arms of the oscillating comb, whereby the cleaning effect is improved and the run off of sand and blasting medium particles is also improved. The plant is therefore suitable also as cleaning apparatus for workpieces blast-cleaned elsewhere. Also, the sealing of the support housing is more effective because a rotary cage transverse to the rotation axis can be better sealed than in the axial direction, as in the known constructions.

DESCRIPTION OF THE DRAWINGS

The invention will be further described with the aid of the exemplary embodiments illustrated in the drawings. They show.

DESCRIPTION OF AN EMBODIMENT OF THE INVENTION

Figure 1:
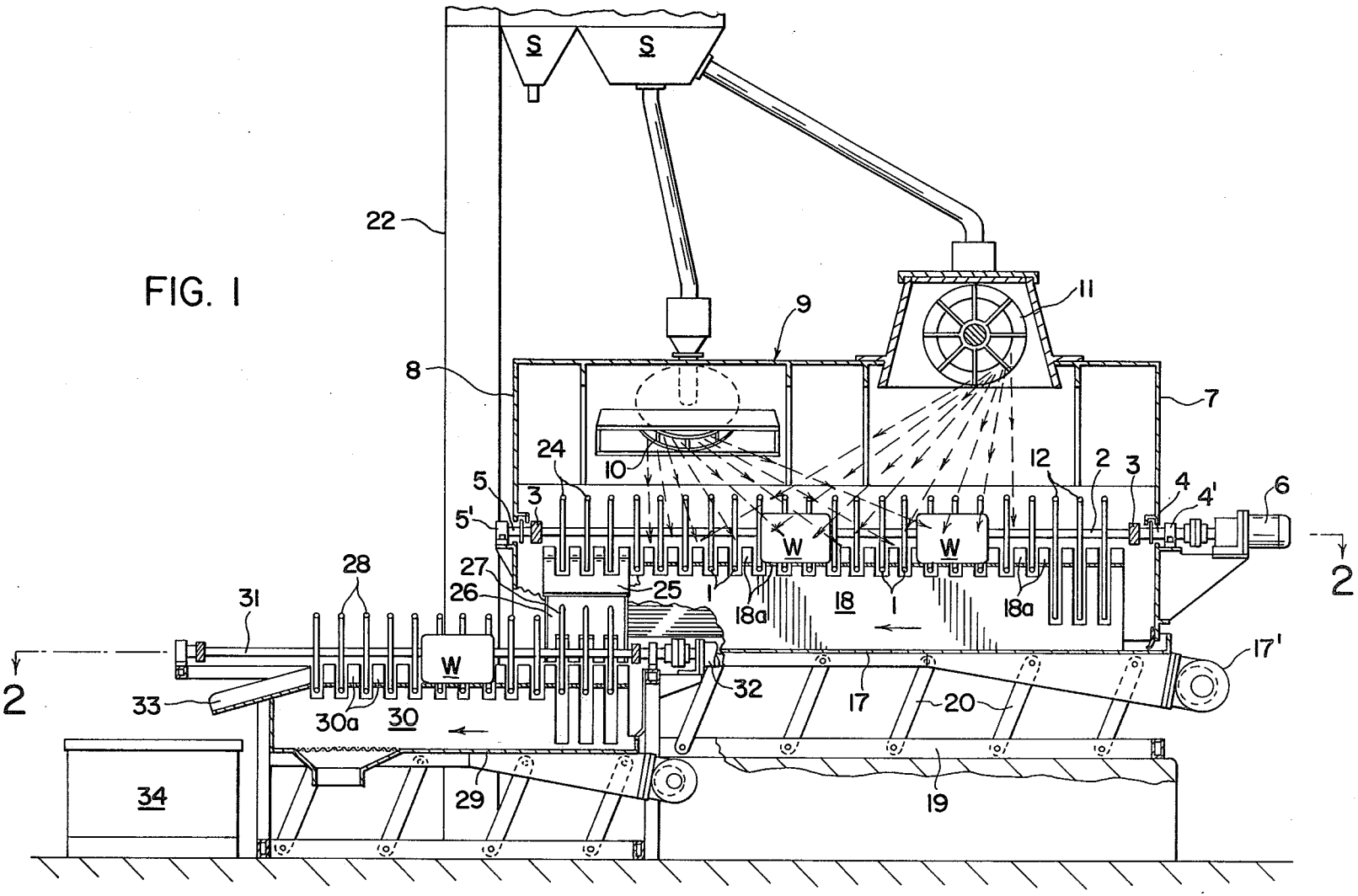
FIG. 1 is a schematic vertical sectional view, partly in section, of the improved apparatus, on line 1—1 of FIG. 2.
Figure 2:
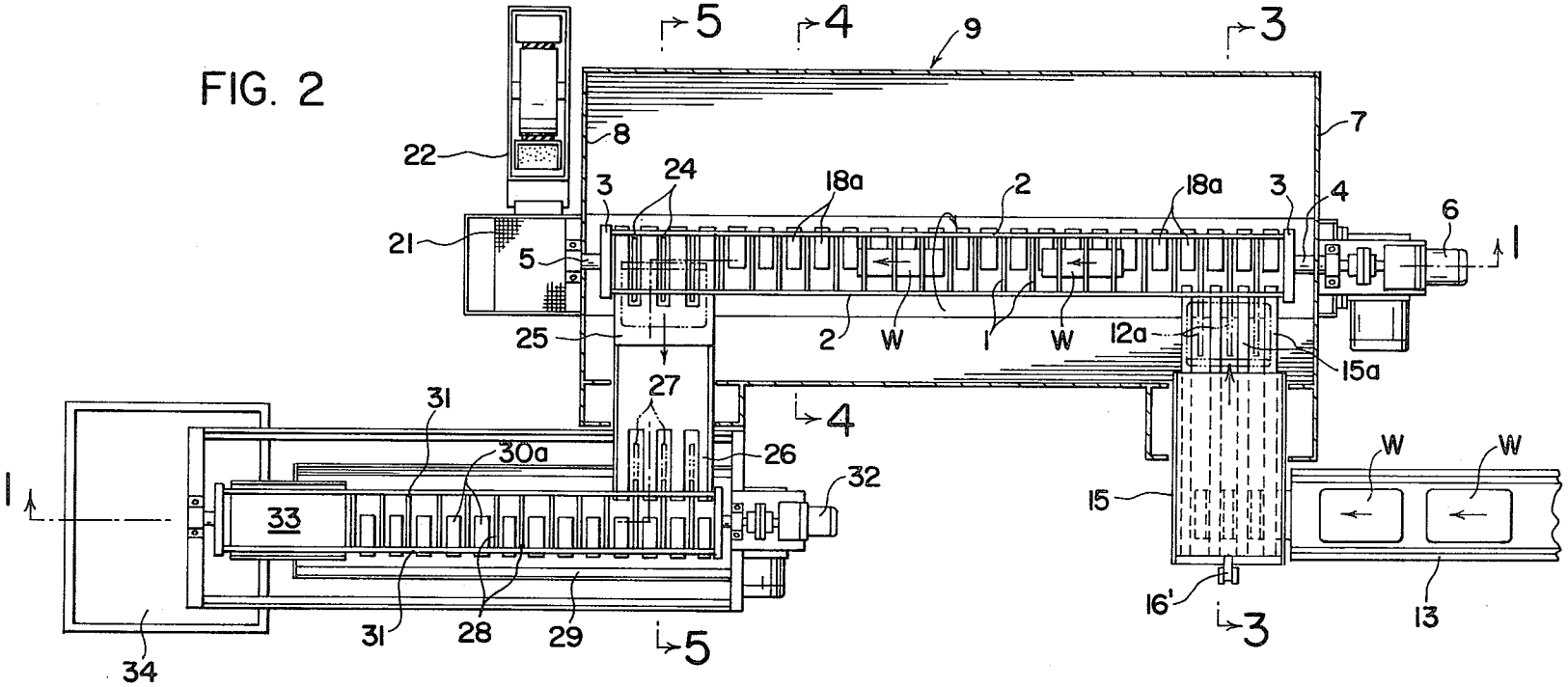
FIG. 2 is a plan view as on line 2—2 of FIG. 1.

The rotary cage (FIGS. 1, 2 and 4) consists of rings 1 which are fastened on a pair of rods 2 extending laterally on the outside, which rods for their part have their ends carried in beams or cross bars 3 mounted on shafts 4 and 5 journaled in bearings 4' and 5' and driven by the motor 6 in rotation. The bearings 4' and 5' are mounted in the side walls 7 and 8 of the support housing 9, which also contains the spinning jet wheels 10 and 11. The housing 9 is suitably supported on columns 9'.

Figure 3:
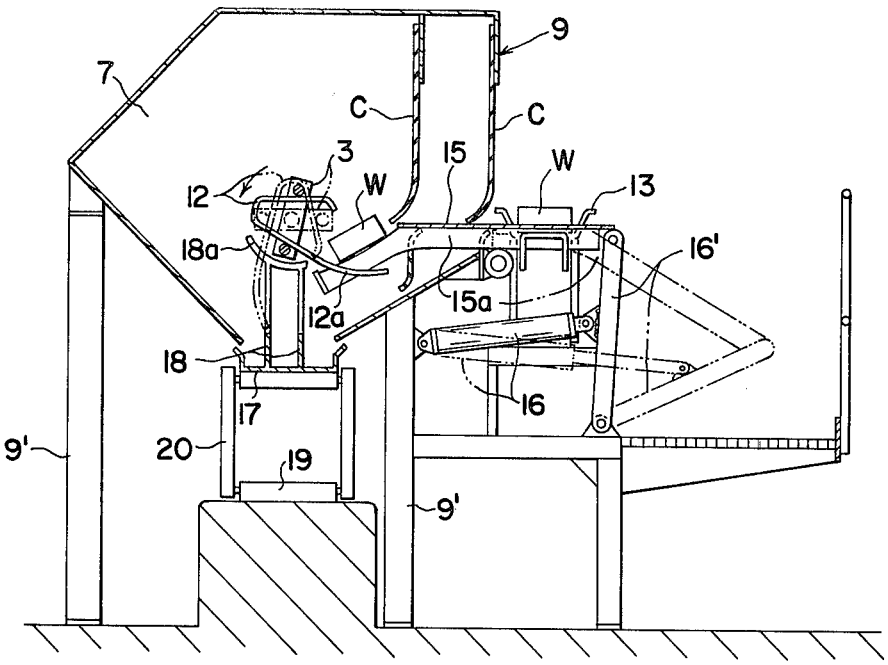
FIG. 3 is a sectional view on the line 3—3 of FIG. 2.

Outside the blast region of the spinning wheels in the housing, forked elements 12 are arranged at the entrance end of the cage facing the drive 6 in place of the rings 1 (FIG. 3). The cross-section of the passage through the forked elements axially conforms to that of the rings 1 and they have prongs **12*a* extending radially outward from this cross-section. The slats 15*a* of a transfer grate 15 move between these prongs (FIG. 2), and the grate transfers workpieces W brought up from the conveyor 13 with a spacing between them and in a longitudinal orientation one after another to the position shown in FIG. 3, on the grate, from where they are picked up by the forked prongs 12*a*** and slide into the passage cross-section of the rotary cage, as this turns in an anti-clockwise direction as shown by the arrow.

The transfer grate 15 is driven by the piston-cylinder unit 16, which actuates the lever 16' so that the workpieces are guided to the rotary cage in synchronism with their spacing on the conveyor 13. Flexible curtains C seal off the housing while allowing entry of the workpieces. In place of the transfer grate, the forked elements can also take the workpieces directly from the conveyor 13, if this is constructed as a roller track for example.

An oscillating channel 17 is arranged underneath the rotary cage, which serves to collect the used jet medium and the sand and rust removed from the workpiece surface by the blasting, has upright extending arms or plates 18 (FIGS. 1, 2, 3 and 4) which have projections at their upper ends extending between the rings 1 in the form of a comb. The projections have curved supporting plates 18*a* at their top ends. The oscillating channel is driven in a known manner by eccentric rotating mechanism indicated at 17' and the channel is movably supported on a base 19 by arms 20.

Figure 4:
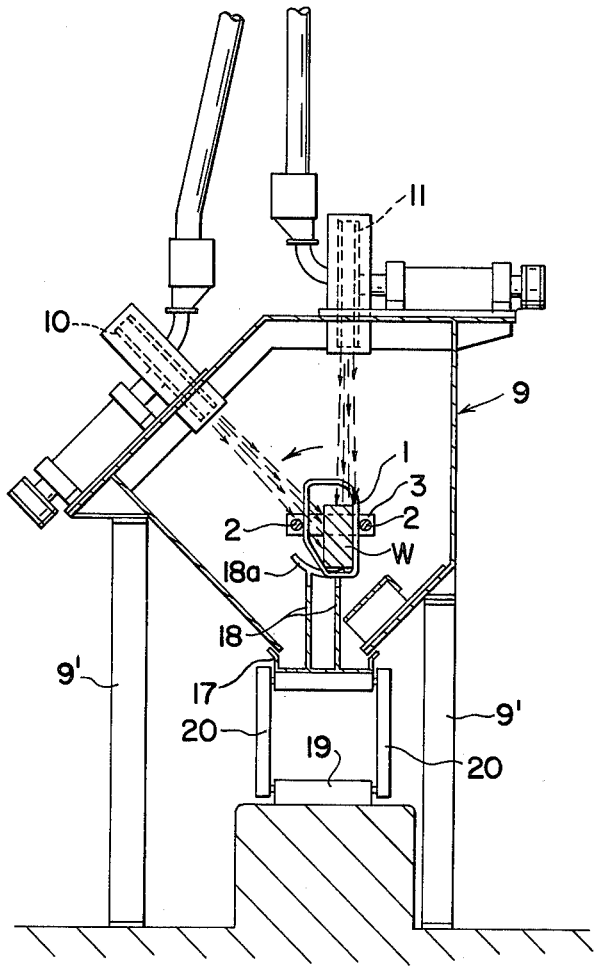
FIG. 4 is a sectional view on line 4—4 of FIG. 2.

During the rotation of the cage, the workpieces to be found in the rings 1 are intermittently carried on one or more of the support plates 18*a* and are moved through the cage by the oscillating movement introduced by the oscillating channel 17, in the direction of the axis of rotation of the cage (the arrow indicated in FIG. 1), and thereby, as is particularly apparent from FIG. 4, are exposed to the blasting medium blast from the spinning wheels 10 and 11. The mixture of the jet blasting medium and material removed from the workpieces passes from channel 17 over a screen 21 and the screened blasting medium is returned via a conveyor 22 to the storage containers S.

Figure 5:
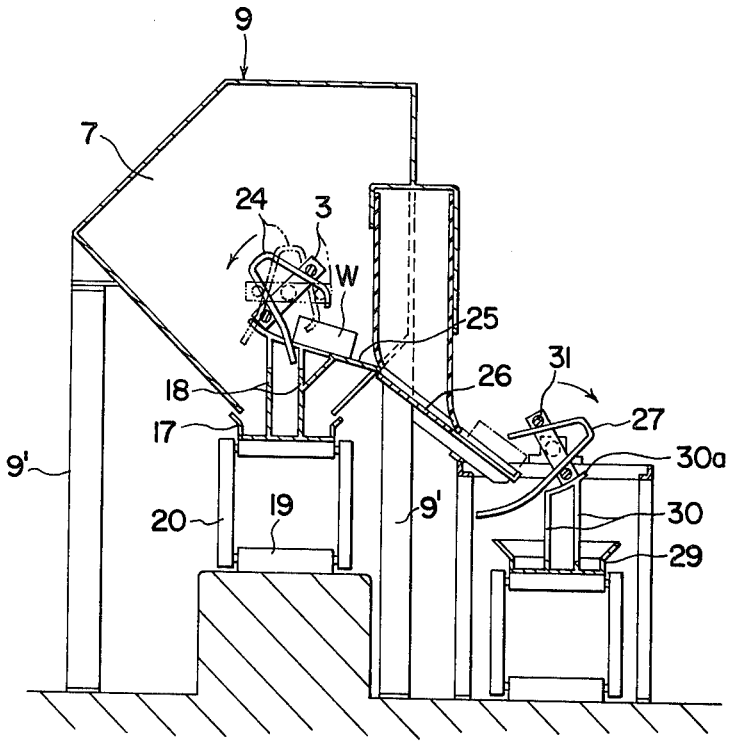
FIG. 5 is a sectional view on line 5—5 of FIG. 2.

U-shaped elements 24 (FIG. 5) likewise axially conforming to the clearance cross-section of the rings are arranged at the discharge end of the cage to move the blasted workpieces W onto an inclined chute 25 carried on one of the arms 18 and from there via a stationary inclined grate 26 into the zone of rotating fork elements 27, which correspond to the fork elements 12 of the cage which have already been described. These fork elements are part of a cleaning device which in the same way as already described has a rotating cage with rings 28, an oscillating channel 29 and arms 30 connected with this as well as carrying plates 30*a* set on their upper ends. The rings are secured to rods 31 and the cage is rotated by motor 32. In this cleaning device, the already-blasted workpieces are finally freed of blasting medium, sand or other residue which still adheres. The workpieces leave the cleaning device via a chute 33 and fall here into a collecting container 34. In place of this type of workpiece output, conveying in the axial direction with the help of the oscillating comb can follow.

I claim:

1. Apparatus for jet blasting workpieces comprising a housing, an elongated cage axially rotatable in said housing for containing the workpieces during blasting and having longitudinally spaced rings, means mounted on the housing for axially rotating said cage, means for jetting a blast medium onto said workpieces in said cage, a series of arms mounted in said housing and extending between said rings for engaging said workpieces, and means for oscillating said arms to move said workpieces axially through the cage as it rotates.

2. Apparatus for jet blasting workpieces as defined in claim 1, wherein the oscillating arms are supported on a channel below the cage adapted to carry away used blasting medium.

3. Apparatus for jet blasting workpieces as defined in claim 1, wherein the spaced rings are constructed to prevent relative turning movement of the workpieces thereon.

4. Apparatus for jet blasting workpieces as defined in claim 1, wherein the through passage cross-section of the rings is so related to the oscillating arms that the arms move into and out of said passage at least once during each rotation of the cage.

5. Apparatus for jet blasting workpieces as defined in claim 1, wherein the cage has at least one forked element at its entrance end axially aligned with said rings and adapted to engage workpieces delivered laterally thereto and guide them into the cage.

6. Apparatus for jet blasting workpieces as defined in claim 1, wherein the cage has at least one U-shaped element at its discharge end axially aligned with said rings and adapted to guide workpieces laterally out of the cage.

7. Apparatus for jet blasting workpieces as defined in claim 5, wherein the cage has at least one U-shaped element at its discharge end axially aligned with said rings and adapted to guide workpieces laterally out of the cage.

8. Apparatus for jet blasting workpieces as defined in claim 6, wherein a second rotary cage is provided in laterally spaced relation to said first cage, and the U-shaped element is adapted to guide workpieces from said first cage to said second cage.

9. Apparatus for jet blasting workpieces as defined in claim 7, wherein a second rotary cage is provided in laterally spaced relation to said first cage, and the U-shaped element is adapted to guide workpieces from said first cage to said second cage.

10. Apparatus for jet blasting workpieces as defined in claim 1, in which diametrically opposed longitudinal rods are connected to said rings, and the rods are secured to cross bars which are operatively connected to said rotating means.

* * * * *